United States Patent [19]

Kodet

[11] 4,262,872

[45] Apr. 21, 1981

[54] COLLAPSIBLE POLE ASSEMBLY

[75] Inventor: Reuben P. Kodet, Manitowoc, Wis.

[73] Assignee: American Hospital Supply Corporation, Evanston, Ill.

[21] Appl. No.: 15,978

[22] Filed: Feb. 28, 1979

[51] Int. Cl.[3] ..... A47K 1/08

[52] U.S. Cl. ..... 248/311.3; 248/291; 248/318; 403/59

[58] Field of Search ..... 248/413, 311.3, 291, 248/293, 318, 150; 108/125; 403/59, 85; 5/508

[56] References Cited

U.S. PATENT DOCUMENTS

| | | | |
|---|---|---|---|
| 1,704,979 | 3/1929 | Kusterle et al. | 5/508 |
| 1,784,108 | 12/1930 | Pearson | 403/59 X |
| 2,470,524 | 5/1949 | Scudder | 248/311.3 X |
| 2,696,963 | 12/1954 | Shepherd | 248/311.3 X |
| 2,957,187 | 10/1960 | Raia | 248/311.3 X |
| 3,424,412 | 1/1969 | Gayle | 248/291 X |
| 3,460,789 | 8/1969 | McKirdy et al. | 248/318 X |
| 3,709,372 | 1/1973 | Alexander | 248/318 X |
| 3,923,279 | 12/1975 | Gresley | 248/318 |
| 3,966,160 | 6/1976 | Wilson | 248/311.3 |
| 4,005,844 | 2/1977 | Richmond | 248/318 X |

FOREIGN PATENT DOCUMENTS

| | | | |
|---|---|---|---|
| 1476061 | 6/1977 | United Kingdom | 248/311.3 |

*Primary Examiner*—J. Franklin Foss

*Attorney, Agent, or Firm*—Larry N. Barger

[57] ABSTRACT

A pole attached to a hospital stretcher or the like for supporting an intravenous solution container. This pole has an improved collapsible construction attaching it to the stretcher so such pole does not interfere with any stretcher operation.

18 Claims, 4 Drawing Figures

FIG. 2
FIG. 1
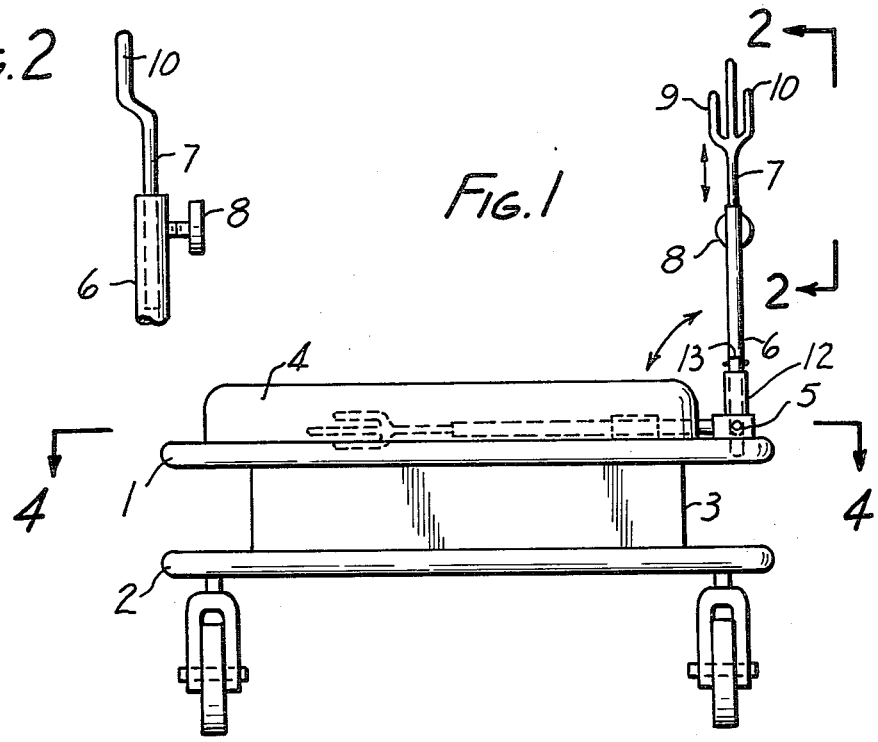
FIG. 3
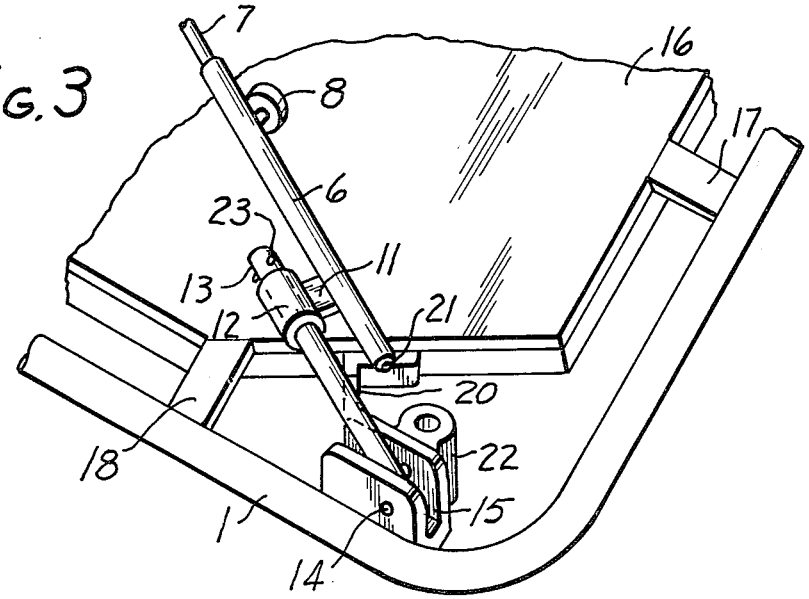
FIG. 4
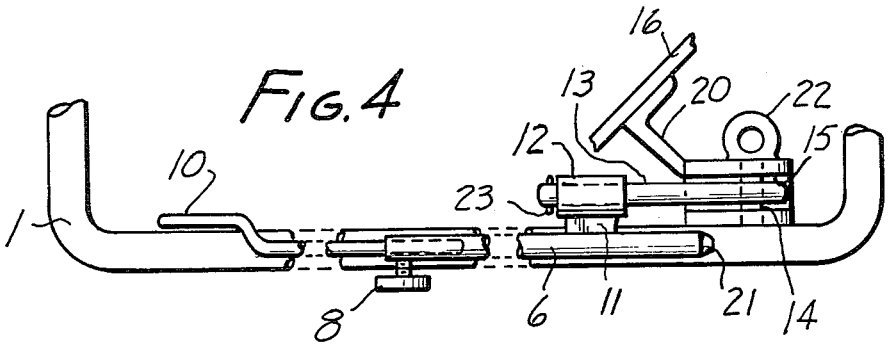

COLLAPSIBLE POLE ASSEMBLY

BACKGROUND

U.S. Pat. No. 3,709,556 describes a telescoping intravenous solution container pole for swivel attachment to one leg of a hospital stretcher or bed. When not in use, this pole is telescopically collapsed and swiveled underneath the mattress support shown in FIG. 5. The vertical height of the collapsed pole would prevent any substantial lowering of the mattress support, and hence would be unusable with many hospital stretchers and beds which are vertically adjustable.

U.S. Pat. No. 1,704,979 shows an intravenous solution container pole which is pivotally connected to a foot end of a mattress support of a hospital bed. Thus, the pole can swing from a vertical operative position to a horizontal stowage position. This construction had a serious disadvantage in that the pole would scrape against the foot of a sheet covered mattress as it swung between its vertical and horizontal position. This would likely scrape against the sheet causing it to become untucked from a foot end of the mattress.

SUMMARY OF THE INVENTION

The present invention overcomes the above problems by providing an intravenous solution container pole that collapses in a unique manner so as not to interfere with any of the operations of a hospital stretcher, including its sheet covered mattress. The collapsible pole assembly includes a shank pivotally connected to a supporting area on the stretcher, and a coupler is longitudinally slidable along this shank. An intravenous solution container pole is rigidly attached to this coupler and combines with the coupler into a sliding unit which engages with a lock on the stretcher securing the pole in operative vertical position. Preferably, the pole is laterally offset from a longitudinal axis of the coupler so as to swivel without the shank for compact stowage of the pole along a rail of the stretcher. During use and storage, the assembly is assuredly retained with the unit to which it is attached.

THE DRAWINGS

FIG. 1 is a front end elevational view of a hospital stretcher showing the intravenous solution container pole;

FIG. 2 is a side elevational view of the pole taken along line 2—2 of FIG. 1;

FIG. 3 is a fragmentary perspective view of the pole in the process of being changed from its vertical operative position to its horizontal stowage position; and FIG. 4 is a view of the pole in stowed position taken along line 4—4 of FIG. 1.

DETAILED DESCRIPTION

In FIG. 1, a mattress support 1 is shown joined to a caster support 2 by a substructure shown schematically at 3. Preferably, this substructure 3 is vertically adjustable by mechanical or electrical means to raise or lower a mattress 4. In most cases, mattress 4 would be covered with a sheet tucked around ends and sides of the mattress. At a corner of mattress support 1 is a supporting base, shown generally at 5, for an intravenous solution container pole. This pole includes a lower section 6 which is telescopically joined to an upper section 7 and lockable in a particular telescopic position by screw knob 8. As shown in FIG. 2, a hook support section is offset in a direction approximately perpendicular to the direction that hooks 9 and 10 protrude. As shown in FIG. 4, such hook construction permits compact horizontal stowage along the stretcher rail.

The construction of the collapsible pole can be seen clearly in FIG. 3 where lower section 6 of the pole is rigidly joined by a spacer 11 to a tubular coupler 12. Coupler 12 can longitudinally slide and rotationally swivel about a pole support, such as shank 13. Shank 13 is pivotally connected through pin 14 to a U-shaped support member 15 which is securely fastened to a rail of mattress support 1. As shown in FIG. 3, the mattress support includes a center structure 16 secured to a rail of mattress support 1 by spacers 17 and 18. Support member 15 included a base 20 that can be welded or otherwise secured to central portion 16 of the mattress support.

To firmly lock the pole in vertical operative position, a tapered end 21 at a bottom of the pole is inserted into a lock socket 22 that is firmly joined to support member 15. Such pole is at a corner of the stretcher so as not to interfere with the stretcher operation or its sheet covered mattress.

When the pole is not in use, it can be conveniently stored in a horizontal position along a rail of the mattress support. This is done by vertically pulling the pole out of socket 22 which longitudinally slides coupler 12 along coaxial shank 13. A stop pin 23 prevents coupler 12 from sliding off the end of shank 13. Once the pole is out of socket 22, coupler 12 can be rotated with a swivel motion about shank 13. Because of the offset structure at the bottom of the pole, the pole moves in an arcuate manner about the swivel's axis which is generally perpendicular to the horizontal pivot axis.

When the pole is so pivoted and swiveled, it can be positioned directly over the rail of mattress support 1. The offset hook support portion of the section 7 of the pole prevents interference of the hooks with a rail of the mattress support, as shown in FIG. 4. Thus, as shown in FIG. 4, the stowed pole extends very compactly along the rail of the mattress support. It does not interfere with the raising and lowering mechanism of the stretcher, the sheet covered mattress of the stretcher, or any other operation of such stretcher. Changing the pole back and forth between stowage and operative positions is extremely simple and uncomplicated.

As shown in FIG. 1, the pole is folded across one end of the stretcher. It is understood that the pole is preferably mounted in a corner of the mattress support structure 1, but could be mounted at any place along its rectangular periphery. Also, the pole can fold down along a foot, head, or side of the stretcher. The pole construction is also suited for use on hospital beds or the like.

In the above description, a specific example has been used to describe the invention. It is understood that persons skilled in the art can make certain modifications to this example without departing from the spirit and scope of the invention.

I claim:

1. A collapsible pole assembly for connection to a patient carrying device comprising: a shank pivotally connected to a supporting base; a coupler longitudinally slidable along the shank; a pole rigidly attached to the coupler to form a sliding unit, said pole being laterally offset from the shank and movable to different sides of the shank without movement of the supporting base;

and a lock on the assembly which is slidably engaged by the unit.

2. A collapsible pole assembly as set forth in claim 1, wherein the coupler can rotationally swivel on the shank.

3. A collapsible pole assembly as set forth in claim 1, wherein the pole has upper and lower sections telescopically joined together for altering the pole's length.

4. A collapsible pole assembly as set forth in claim 1, wherein the lock includes a socket into which at least a portion of the sliding unit is received to firmly lock the pole in an upright position.

5. A collapsible pole assembly as set forth in claim 4, wherein the pole of the sliding unit has a lower end portion that is received in the socket.

6. A collapsible pole assembly as set forth in claim 1, wherein the shank has a limit stop to prevent disengagement of the shank and slidable coupler.

7. A collapsible pole assembly as set forth in claim 6, wherein the limit stop is a protruding pin anchored to the shank.

8. A collapsible pole assembly as set forth in claim 1, wherein the pole has a longitudinal axis and a hook support area offset in a first lateral direction; and a hook attached to the hook support area and protruding in a second lateral direction, whereby the pole can be compactly stored along a rail of a patient carrying device without undue interference between the hook and such rail.

9. A collapsible pole assembly as set forth in claim 8, wherein the first and second lateral directions are approximately perpendicular to each other.

10. A collapsible pole assembly as set forth in claim 8, wherein the pole has a lower section anchored to the coupler and an upper section telescopically joined to the pole's lower section; and the offset hook support area is on the upper section.

11. A patient carrying device with a collapsible pole assembly wherein the improvement comprises: a shank pivotally connected to such device; a coupler longitudinally slidable along the shank; a pole rigidly attached to the coupler to form a sliding unit, said pole being laterally offset from the shank and movable to different sides of the shank without movement of the patient carrying device; and a lock on the assembly is slidably engaged by the unit.

12. A patient carrying device with a collapsible pole assembly, wherein the improvement comprises: a base connected to the device; a pole support pivotally connected to the base at a generally horizontal pivot axis; a lock on the device for holding a pole in a generally vertical position during use; and a pole connected to and longitudinally movable relative to the pole support to engage and disengage such lock, said pole being laterally offset from the pole support and movable to different sides of the pole support without movement of the patient carrying device.

13. A patient carrying device as set forth in claim 12, wherein the lock includes a socket.

14. A patient carrying device as set forth in claim 12, wherein the pole support has a longitudinal axis, and the pole is joined to a coupling structure that is coaxial with the pole support causing remaining portions of the pole to swivel about the pole support in an arcuate manner.

15. A patient carrying device with a collapsible pole assembly, wherein the improvement comprises: a base; a pole that is pivotally joined to the base by means of a coupling structure that is laterally offset from the pole with the coupling structure having a portion pivotally connected to the base at a generally horizontal pivot axis; and a swivel joint on the assembly permitting the pole to move about a swivel axis to different sides of the swivel axis without movement of the base, which swivel axis has a nonparallel relationship to the pivot axis, whereby the pole can move relative to both axes in moving between a compact generally horizontal storage position and a generally vertical position.

16. A patient carrying device as set forth in claim 15, wherein the swivel and pivot axis are approximately perpendicular to each other.

17. A patient carrying device as set forth in claim 15, wherein the pole is connected to an offset structure that is coaxial with the swivel axis, whereby the pole swings in an arcuate motion about the offset structure.

18. A patient carrying device with a collapsible pole assembly, wherein the improvement comprises: an elongaged pole; a pivot member joining a bottom end portion of the pole to such device along a pivot axis that is generally horizontal; said pivot axis being approximately perpendicular to a support rail of the device, whereby the pole can be pivoted to a generally horizontal storage position against such rail; a laterally offset protruding hanger at an upper end portion of the pole, which offset hanger extends away from the rail so as not to interfere with the rail when the pole is in such generally horizontal storage position against the rail for compact nesting with such rail; and lock means on the device for securing the pole in a generally vertical position during use.

* * * * *